US007023461B2

(12) United States Patent
Verdyck

(10) Patent No.: US 7,023,461 B2
(45) Date of Patent: Apr. 4, 2006

(54) DECONVOLUTION SCHEME FOR REDUCING CROSS-TALK DURING AN IN THE LINE PRINTING SEQUENCE

(75) Inventor: Dirk Verdyck, Merksem (BE)

(73) Assignee: Agfa-Gevaert, Mortsel (BE)

( * ) Notice: Subject to any disclaimer, the term of this patent is extended or adjusted under 35 U.S.C. 154(b) by 139 days.

(21) Appl. No.: 10/738,816

(22) Filed: Dec. 17, 2003

(65) Prior Publication Data

US 2004/0135869 A1 Jul. 15, 2004

Related U.S. Application Data

(60) Provisional application No. 60/440,470, filed on Jan. 15, 2003.

(30) Foreign Application Priority Data

Dec. 17, 2002 (EP) ..... 02102775

(51) Int. Cl.
*B41J 2/365* (2006.01)

(52) U.S. Cl. ..... 347/195

(58) Field of Classification Search ..... 347/182, 347/188, 194–196; 400/120.05, 120.15, 400/120.06, 120.09
See application file for complete search history.

(56) References Cited

U.S. PATENT DOCUMENTS 4,360,818 A 11/1982 Moriguchi et al.
4,366,489 A * 12/1982 Yamaguchi ..... 347/182
5,483,273 A 1/1996 Fujimoto et al.
5,702,188 A 12/1997 Watanabe et al.
5,719,615 A 2/1998 Hashiguchi et al.
5,815,191 A * 9/1998 Michielsen et al. ..... 347/188
6,008,831 A 12/1999 Nakanishi et al.

FOREIGN PATENT DOCUMENTS

EP 0 304 916 A1 3/1989
EP 1 234 677 A1 8/2002
EP 02 10 2775 5/2003
FR 2 808 476 11/2001

* cited by examiner

*Primary Examiner*—Huan Tran
(74) *Attorney, Agent, or Firm*—John A. Merecki; Robert A. Sabourin

(57) ABSTRACT

The present invention relates to a method for reducing or eliminating cross-talk when operating a thermal print head for printing one line on a recording medium.

Energizable heater elements of a thermal print head are drivable with at least one activation pulse for supplying a controllable amount of heat to the heater elements to generate a graphical output level of pixel areas on thermographic material. According to the method a plurality of subsets of the heater elements are sequentially driven to print pixel areas in each line. The cross-talk between pixel areas printed by heater elements in the same and/or different subsets is reduced by calculating a value relating to heat supplied to an $n^{th}$ heater element in accordance with a predetermined relationship relating the effect of heat from any one heater element after activation thereof on the graphical output of neighboring heater elements in the same and/or a different subset, and by driving the $n^{th}$ heater element in accordance with the calculated value.

13 Claims, 3 Drawing Sheets

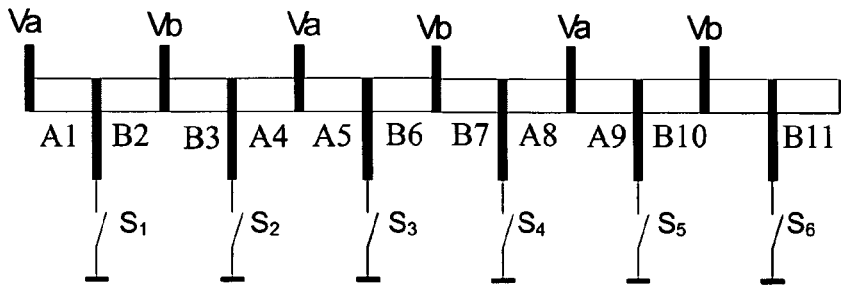
Fig. 1 - PRIOR ART
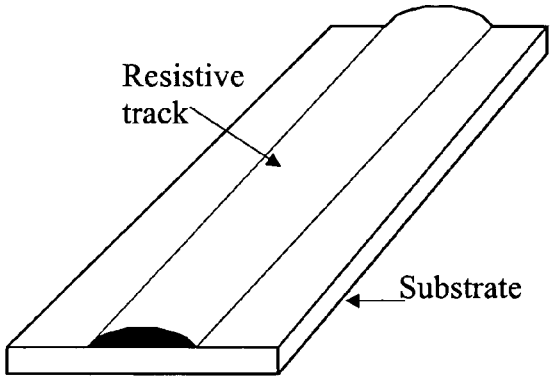
Fig. 2 - PRIOR ART
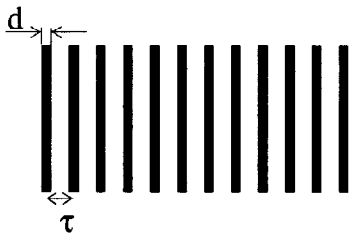
Fig. 3
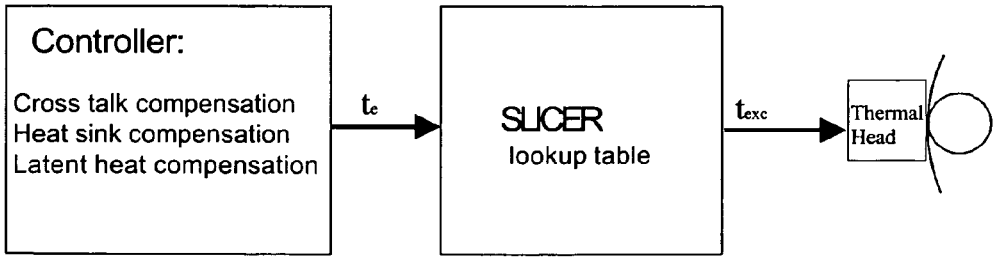
Fig. 4

DECONVOLUTION SCHEME FOR REDUCING CROSS-TALK DURING AN IN THE LINE PRINTING SEQUENCE

The application claims the benefit of U.S. Provisional Application No. 60/440470 filed Jan. 15, 2003.

TECHNICAL FIELD OF THE INVENTION

The present invention relates to a method for reducing or eliminating cross-talk when operating a thermal print head for printing one line on a recording medium. The thermal head has energisable heater elements which are individually addressable. In particular, the recording medium is a thermographic material, and the head relates to thermal imaging, generally called thermography.

BACKGROUND OF THE INVENTION

Thermal imaging or thermography is a recording process wherein images are generated by the use of imagewise-modulated thermal energy. Thermography is concerned with materials which are not photosensitive, but are sensitive to heat or thermosensitive and wherein imagewise applied heat is sufficient to bring about a visible change in a thermosensitive imaging material, by a chemical or a physical process which changes the optical density.

Most of the direct thermographic recording materials are of the chemical type. On heating to a certain conversion temperature, an irreversible chemical reaction takes place and a coloured image is produced.

In direct thermal printing, the heating of the thermographic recording material may be originating from image signals which are converted to electric pulses and then through a driver circuit selectively transferred to a thermal print head. The thermal print head consists of microscopic heat resistor elements, which convert the electrical energy into heat via the Joule effect. The electric pulses thus converted into thermal signals manifest themselves as heat transferred to the surface of the thermographic material, e.g. paper, wherein the chemical reaction resulting in colour development takes place. This principle is described in "Handbook of Imaging Materials" (edited by Arthur S. Diamond—Diamond Research Corporation—Ventura, Calif., printed by Marcel Dekker, Inc. 270 Madison Avenue, New York, ed. 1991, p. 498–499).

A particular interesting direct thermal imaging element uses an organic silver salt in combination with a reducing agent. An image can be obtained with such a material because under influence of heat the silver salt is developed to metallic silver.

A thermal impact printer uses thus heat generated in resistor elements to produce in a certain image forming material, a localised temperature rise at a certain point, which, when driven high enough above a threshold temperature and being kept a certain time above this threshold temperature, gives a visual pixel. In practice, many pixels are being formed in parallel on a same line and then repeated on a line by line basis where the thermographic medium is moved each time over a small position.

The application of thermal heads is evolving more and more towards high resolution schemes. In the early years, thermal heads had low resolutions only (120 dpi), but starting from the early 80's, new technological inventions have driven this resolution into the 600 dpi area (e.g. U.S. Pat. No. 4,360,818 or 5,702,188). Unfortunately, this technology always puts some constraints on the electrical configuration and the controllability of the individual nibs. This comes from the fact that in most cases the construction is based on a screen printing technology which has limited resolution but gives a low cost and fast manufacturing benefit. Constrained by this limited resolution, special configurations are being used to increase the printing resolution of the thermal head despite some electrical inconveniences:

- not all nibs are addressable at the same time. For this purpose, a switching in the supply voltage system must be performed. Neighbouring nibs in fact use partly the same switch for controlling the on/off state. Selection of the neighbouring nib is done using the power supply system.
- not printing a pixel with a nib during an active time slice will still generate power in the nib, being of course much lower than the power of an activated nib.

Normally, this "time multiplexing" of control electronics in such a head will only lower the printing speed as not all nibs can be excited simultaneously and accordingly, this groups of nibs must be printed one after the other in time. This is illustrated in FIG. 1 based on U.S. Pat. No. 5,702,188. Here, every 2 nibs will have a common switch $S_i$ to the ground potential, effectively having 1 electronics switch $S_i$ for controlling two adjacent nibs. Selection of the left or right nib sharing a same switch $S_i$ is done by taking appropriate values of the voltages $V_a$ and $V_b$. In this case, a total line can only be printed using two print jobs controlling each time the same electronic switches but having a different set of supply voltages in the two cases. This way of controlling the thermal head will be denoted in the present invention disclosure by "a sub line printing method". In each sub line, a specific group or set of heater elements or nibs are being addressed and the combination of all sub lines produces a full graphical line, having addressed all the heater elements over the full printing range of the print head.

The method of using "time multiplexing" for printing a full pixel line has some consequences on the graphical output because of two reasons: film movement and thermal coupling.

The process of printing a pixel line in 2 or more time frames will increase the length of the total time for printing a line. The transport of the graphical medium is normally of such a kind that medium transport will occur outside the time frame when the actual pixel printing happens. But this is only theory. The real movement of the graphical medium is rather complex because of the many mass-spring systems present in the system. For example mostly a rubber roller is used for pressing the medium against the nib line of the printer. This is a very elastic medium with distributed mass. The friction forces between the medium and the print head mostly also depend strongly on the thermal state of the nib line as the emulsion layer will undergo some hardness variations when heated up, this with the purpose of increasing diffusion processes inside the material for accelerating the image forming process. The drive system consisting of an electrical motor (reluctance based, PM based or mixed), belt systems, gears, . . . etc. also adds equivalent springs and inertia to the drive system. Because of the rapid acceleration and deceleration wanted regarding the medium transport, vibrations will be present on the transient phase of the movement. This means that when printing one group of pixels on the image forming material, it is not always guaranteed that the medium will be in exactly the same position when printing the next group of pixels. The more time is present between the printing of these 2 (or possibly even more) groups of pixels, the more chance one might have that vibrations on the medium transport will give a misalignment of the graphical output of these pixel groups. This will lead to Moiré effects in the graphical output and is not allowed.

Adjacent nibs are mostly thermally linked with each other. Heat transport from one nib to another occurs, mostly by conductive means, partly by radiative means. E.g. with reference to FIG. 1, when printing the A-pixels, a lot of heat will be transferred to the B-nibs, giving in practice a substantially increased graphical output depending on the thermal coupling between the A and B-nibs. Again, different pixel size between the several printed pixel groups may be found, giving again Moiré effects in the graphical output.

In a thick film head, the electrical resistance is formed by the deposition of a continuous track of a resistive conductive paste on a substrate, as shown in FIG. 2, e.g. using a screening technique. Electric contact fingers can already be present on this substrate or can be deposited later on the surface of the resistive nib line itself. Because of its construction, the nib track forms a continuous thermal structure without any barriers for heat inside. In fact, the individual nibs are formed by a delimitation of the electrical current configuration due to the location of the electrical contact fingers. But for heat, there is no delimitation, making that heat will always spread along the nib line when generated in one of the individual 'nibs'. This is the ultimate reason for having cross-talk between neighbouring nibs and when printing a single line in several time frames. A control algorithm must determine for every nib of the thermographic print head the amount of energy that must be dissipated in the resistive element. Depending on the thermal construction of the thermal head, this can be a very simple controller, e.g. all nibs are isolated from each other, giving no visual interaction on the printed medium between the several pixels. But in practice, the controller algorithm must deal with a variety of real-world problems.

A first of such problems is the changing characteristics of the thermographic medium, giving different pixel sizes for a same nib energy, e.g. some examples:

a different physical thickness of the emulsion layer a different chemical composition of the image forming components.

A second problem is formed by changing environmental characteristics like temperature and humidity:

a temperature rise of the environment must be taken into account as the image forming temperature will not rise as it is determined by the chemical composition of the emulsion layer humidity changes the thermal capacity of the emulsion, producing different temperature rises when applying the same amount of energy.

A third problem is that the thermal process itself produces an excessive amount of heat which is not absorbed by the image forming medium. This excessive heat is absorbed by a heat sink, but nevertheless, gives rise to temperature gradients internally in the head, giving offset temperatures in the nibs and between the plurality of nibs. E.g. when the image forming process must have an accuracy of 1° C. in the image forming medium, an increased offset temperature of 5° C. in the heat generating element must be taken into account when calculating the power to be applied to that element.

A fourth problem is that the heat generating elements are in the ideal case fully thermally isolated from each other. In practice however, this is never the case and cross-talk between the plurality of nibs occurs. This cross-talk can be localised on several levels:

heat transfer between the plurality of nibs in the thermal head structure itself.

heat transfer in the emulsion and film layer itself.

pixels are not printed one aside the other, but partly do overlap on the print medium, mechanically mixing heat from one pixel with the other.

A further problem is that the electrical excitation of the nibs does mostly not happen on an isolated base. This means that not every nib resistor has its own electrical voltage supply which can be driven independent of all the other nibs. In general, some drive signals for driving the nibs are common to each other, this with the purpose of having reduced wiring and drive signals. In general, all nibs can be only switched on or off in the same time-frame. Producing different weighted excitations can only be achieved by dividing the excitation interval in several smaller intervals, where for every interval it can be decided whether the individual nib has to be switched on or off. This process of "slicing" has its influence on the thermal image forming process. For example: giving a pattern excitation with the weights (or driving times) (128,0,0,0,0,0,0,0) and (0,64,32,16,8,4,2,1) is mathematically only 1 point different, but the pixel size will be much more different than just 1 point in case of a commercial thermal head, because a '0'-no excitation interval produced in that specific device, produces heat in the nib as well! The controller has to take this effect into account.

In order to improve accuracy, the number of driving power levels has been increased, the nibs have got a higher resolution by decreasing the nib spacing, paper has been used which needs more heating or longer heating times, or which have a steeper characteristic (in order to increase pixel edge sharpness), but none of these solutions result in the improvement thought of, because a cross-talk problem comes in.

One way to counter-act on cross-talk is by making the active print period of each sub line, also called sub line time hereinafter, as short as possible. The longer it takes for a sub line to print, the more time is given to the heat to spread among the neighbouring nibs. Of course, a minimal time is present for each sub line, as the heater elements have a limit on the thermal power they can deliver and a minimum input power is necessary for the thermographic material to produce an image forming chemical reaction. The disadvantage of using a short sub line time is the fact that the controllability of the whole system is minimised, as there is no or little time left to produce numerous time slices, a technique necessary to control the power to the plurality of heater elements when being driven all by a common strobe signal (e.g. explained in EP-1234677). In practice, accurate control of the energy delivered to a heater element is mandatory, so as to compensate for shifted offset temperature in the heater element itself, the substrate carrying the heater element and parts of the heat sink. This shifted offset temperature is generated by latent heat present in parts of the print head because of printing activity in the past. As this latent heat depends strongly on the image information, a varying temperature profile can be found along the heater element zones in the print head and for accurate control, depending on the offset temperature in the heater element, an appropriate amount of energy must be delivered to the heater element in order to create equal size or equal dense pixels on the graphical medium. In practice, to avoid Moiré-effects in the graphical output and in order to obtain a uniform graphical output, independent of printing history, an accurate control on the temperature in the heater element is necessary and this accurate control should be independent of the location of the heater element. Using a time slice excitation scheme with a common strobe signal for driving all the heater elements, this individual heater element controllability can only be realised by taking numerous time slices, inevitably elongating the total time necessary to print a sub line.

However, using more time slices in a sub line, in favour of an increased controllability of the energy delivered to every heater element, does increase the total sub line time and, as a consequence, increases the cross-talk between the pixels being printed, as an elongated printing time allows the heat from one pixel to spread further to another one. This cross-talk inevitably generates Moiré-effects in the printout and puts bounds on the number of time slices that can be used in a sub line.

As an alternative to prevent Moiré effects, it is possible to increase the number of sub lines when printing a line and to introduce short waiting times between printing of different sub lines. Increasing the number of sub lines has the benefit of printing pixels more isolated from each other, making cross-talk more difficult by increasing the distance between nibs being active at the same instance of time. When having short waiting times between printing sub lines, the latent heat present in the nib structure has the time to spread and flow to the heat sink structure. This increase of the number of sub lines together with a good controllability of every sub line because of the presence of many time slices, allows to make high quality pictures. Unfortunately, this way the total line time will increase, giving, as a consequence, a lower graphical throughput of the printing device (measured in square meter/hour), something which is from an economical point of view mostly not acceptable. Therefore, one will mostly choose for a high material throughput of the printing device, despite the lower graphical quality of the printed material. Printing lines in two sub lines is known in industry with acceptable but unsatisfactory quality, and it is mostly used for screen making. No proposals for improvement of the image have been made, which is necessary if this method would be used for making film to illuminate. In that case, it must be possible to print e.g. 99% black, which is impossible at present.

SUMMARY OF THE INVENTION

It is an object of the present invention to reduce cross-talk between pixel areas printed in a line on a thermographic material.

The above objectives is accomplished by a method and device according to the present invention. According to the present invention the print quality is increased, while retaining the number of sub lines to a minimum and allowing for larger sub line times and accordingly more time slices and increased controllability. Therefore, an improved control strategy when printing the sub lines is provided.

The present invention provides a method for reducing cross-talk between pixel areas printed in a line on a thermographic material by a thermal printing system comprising a thermal printer with a thermal head having a set of energisable heater elements. The energisable heater elements are drivable with at least one activation pulse for supplying a controllable amount of heat to the heater elements to generate a graphical output level of pixel areas on the thermographic material. The method is characterised by sequentially driving a plurality of subsets of the heater elements to print pixel areas in each line, and reducing the cross-talk between pixel areas printed by heater elements in the same and/or different subsets by calculating a value relating to heat supplied to an $n^{th}$ heater element in accordance with a predetermined relationship relating the effect of heat from any one heater element after activation thereof on the graphical output of neighbouring heater elements in the same and/or a different subset, and driving the $n^{th}$ heater element in accordance with the calculated value.

The predetermined relationship may be a discrete set of coefficients relating the effects of heat from one heater element after activation thereof on the graphical output of neighbouring heater elements in space and time. The predetermined relationship is in the form of a matrix. This matrix has coefficients, which may be found on an experimental a posteriori base by using a special graphical printout of pixels chosen in such a way that a graphical output level is influenced by a single neighbouring pixel with a corresponding heat transfer coefficient, allowing to adjust this coefficient until the graphical output level is identical to the same graphical output level when being printed when p is not excited.

The number of subsets of the heater elements may be at least two.

A method according to the present invention may furthermore comprise line to line latent heat compensation.

A method according to the present invention may comprise the steps of: building system equations that relate the excitation an actual heater element will get as a result of the contributions of the neighbouring heater elements being driven, based upon the predetermined relationship, the actual heater element excitation and the non-image related sub line heat production vector, for every line to be printed, putting the total excitation value equal to a first reference value for every pixel that will be printed and equal to a second value for every pixel not being printed, solving the system of equations for the unknown values of excitations to be applied to the heater elements, repeating the above sequence by recalculating the second values and resolving the system of equations until the vector of excitation values converges with an acceptable error.

The second value may be calculated from the system equations using for the first time the first reference value for the excited heater elements and in subsequent iterations, the excitation values found at the heater elements being excited and a zero-value at the non-excited heater elements.

Building the system equations describing the thermal printing process may comprise:

defining the printing sequence by selecting for every heater element in what sub line it will be excited: $t_{r,n}^{e}$, r the sub line number, n the heater element number.

for every excited heater element, using a convolution principle and the predetermined relationship, the resulting total equivalent pixel excitation $t_{r,n}^{total}$ being calculated using:

$$t_{r,n}^{total} = \sum_{j=0}^{r}\left[\sum_{i=0}^{n} t_{r-j,n-i}^{e} H_{j,i} + \sum_{i=1}^{N_{nibs}-1-n} t_{r-j,n+i}^{e} H_{j,i}\right] + t_{r}^{add},$$

$$r = 0, \ldots, N_s - 1 \quad n = 0, \ldots, N_{nibs} - 1.$$

based on the selected excitation scheme, for heater element n, focus only on the equivalent steering time $t_{r,n}^{total}$ in the sub line r, the actual sub line wherein the heater element is actively excited, giving in total $N_{nibs}$ equations for $N_{nibs}$ unknown excitation values.

The basic convolutional expression may be replaced by an expression giving an isolated boundary condition in the thermal head:

$$t_{r,n}^{total} = \sum_{j=0}^{r}\left[\sum_{i=0}^{N_{nibs}-1} t_{r-j,\zeta}^{e} H_{j,i} + \sum_{i=1}^{N_{nibs}-1-n} t_{r-j,\eta}^{e} H_{j,i}\right] + t_{r}^{add} \text{ with}$$

$$\zeta = |n-i|$$

and if $(n+i)>(N_{nibs}-1)$ then $\eta=2(N_{nibs}-1)-n-i$, else $\eta=n+i$.

The present invention also provides a control unit for use with a thermal printer for printing an image onto a thermographic material, the thermal printer having a thermal head having a set of energisable heater elements, the control unit being adapted to control the driving of the heater elements with at least one activation pulse for supplying a controllable amount of heat to the heater elements to generate a graphical output level of pixel areas on the thermographic material, the control unit furthermore being adapted for controlling the driving of a plurality of subsets of the heater elements to print pixel areas in each line, and for reducing the cross-talk between pixel areas printed by heater elements in the same or different subsets by calculating a value relating to heat supplied to a first heater element in accordance with a predetermined relationship relating the effect of heat from one heater element after activation thereof on the graphical output of neighbouring heater elements in the same and/or different subsets, and for driving the first heater element in accordance with the calculated value.

The present invention furthermore provides a thermal print head provided with a control unit according to the present invention. According to an embodiment, the thermal print head may be a thin film head; According to another embodiment, the thermal print head may be a thick film head.

The present invention also provides a computer program product for executing any of the methods of the present invention when executed on a computing device associated with a thermal print head, and a machine readable data storage device storing the computer program product of the present invention.

With the method of the present invention, it is possible to print e.g. 99% black.

These and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

BRIEF DESCRIPTION OF THE DRAWINGS

FIG. 1 shows an example of a thick film nib line structure having electrical contact fingers to the nib line at 300 dpi but allowing to print at 600 dpi by sharing two nibs to a same electronics switch and with additional switching on the Va and Vb voltages with which the present invention can be used.

FIG. 2 is a perspective view of a thick film thermal print head showing the nib track deposited on a substrate with which the present invention can be used. The electrical contact fingers are not shown.

FIG. 3 is a printout with each line 1 pixel (d micrometers) wide, the lines being printed with a periodicity $\tau$.

FIG. 4 is a schematic overview of a driver structure of a thermal head consisting of a controller and a slicer which realises the requested nib driving times with which the present invention can be used.

DESCRIPTION OF ILLUSTRATIVE EMBODIMENTS

Figure 5:
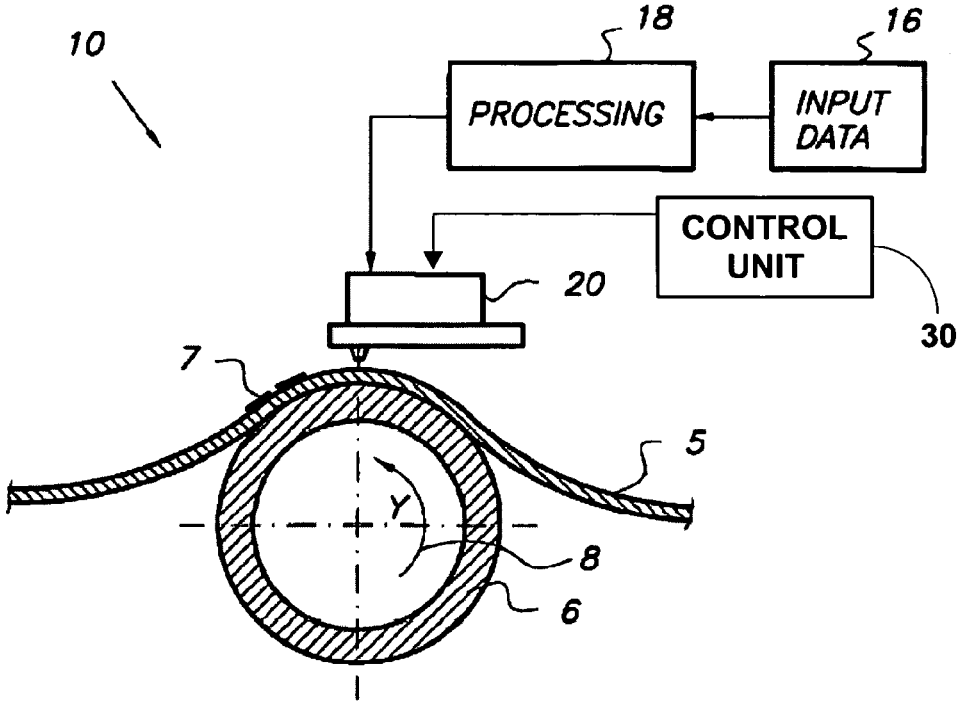
FIG. 5 shows some basic functions of a direct thermal printer with which the present invention can be used.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes.

Explanation of Terms

For the sake of clarity, the meaning of some specific terms applying to the specification and to the claims are explained before use.

An "original" is any hardcopy or softcopy containing information as an image in the form of variations in optical density, transmission, or opacity. Each original is composed of a number of picture elements, so-called "pixels". Further, in the present application, the terms pixel and pixel area are regarded as equivalent.

Furthermore, according to the present invention, the term pixel may relate to an input image (known as original) as well as to an output image (in softcopy or in hardcopy, e.g. known as a print or printout).

The term "thermographic material" (being a thermographic recording material) comprises both a thermosensitive imaging material and a photothermographic imaging material (being a photosensitive thermally developable photographic material).

For the purposes of the present specification, a "thermographic imaging element" is a part of a thermographic material.

By analogy, a thermographic imaging element comprises both a (direct or indirect) thermal imaging element and a photothermographic imaging element. In the present application the term thermographic imaging element will mostly be shortened to the term imaging element.

By the term "heating material" is meant a layer of material which is electrically conductive so that heat is generated when it is activated by an electrical power supply.

In the present specification, a heater element is a part of the heating material. A "heater element" (also indicated as "nib") being a part of the heating material is conventionally a rectangular or square portion defined by the geometry of suitable electrodes.

A "platen" comprises any means for firmly pushing a thermographic material against a heating material, e.g. a drum or a roller.

According to the present specification, a heater element is also part of a "thermal printing system", which system further comprises a power supply, a data capture unit, a processor, a switching matrix, leads, etc.

The index 'n' is used as an subscript with regard to nib numbers, n=0,1, . . . ,Nnibs−1 with Nnibs the total number of nibs on the thermal head.

A "heat diffusion process" is a process of transfer of thermal energy (by diffusion) in solid materials.

An "activation pulse" is an energy pulse supplied to a heater element, described by a certain energy given during a defined time interval ts. The elementary time interval ts during which a strobe signal is active is often called a "time slice". The term "time slice of activation pulses" explicitly indicates that during a time slice, and hence during a same strobe signal, the individual heater elements may be individually and independently activated or non activated by corresponding activation pulses.

The term "controllability" of a thermal printing system denotes the ability to precisely control the output of a pixel, independent from the position of the pixel, the presence of pixel neighbours, the environmental conditions and the past thermal history of the printing process.

The term "compensation" denotes the process of determining the exact amount of thermal energy that has to be delivered to a heater element in order to achieve a controlled graphical output.

A "specific mass ρ" is a physical property of a material and means mass per volumetric unit [kg/m$^3$].

A "specific heat c" means a coefficient c describing a thermal energy per unit of mass and per unit of temperature in a solid material at a temperature T [J/kg·K].

A "thermal conductivity λ" is a coefficient describing the ability of a solid material to conduct heat, as defined by Fourier's law $$q = -\lambda \cdot \frac{dT}{dx};$$

λ is expressed e.g. in [W/(m·K)]. An extension from λ to anisotropic materials is possible by replacing λ by a tensor $\overline{\lambda}$. In that case $\overline{q} = -\overline{\lambda}$ grad(T) holds.

It is known, and put to intensive commercial use (e.g. Drystar™, of Agfa-Gevaert), to prepare both black-and-white and coloured half-tone images by the use of a thermal printing head, a heat-sensitive material (in case of so-called one-sheet thermal printing) or a combination of a heat-sensitive donor material and a receiving (or acceptor) material (in case of so-called two-sheet thermal printing), and a transport device which moves the receiving material or the donor-acceptor combination relative to the thermal printing head.

Detailed Description

The process of printing a single pixel line in several time frames, each time addressing different or even the same subset of heater elements of a thermographic print head, will be denoted in the present patent application as a printout using several sub lines. For example in FIG. 1, the first sub line might consist of printing pixel areas using only the A-nibs, the second sub line might consist of printing pixel areas using only the B-nibs. But more exotic printing schemes could also be used, e.g. in every sub line, every fourth nib prints a pixel area, if necessary (depending on the content of the image to be printed): in sub line 1, nibs A4, A8, . . . can be driven, in sub line 2, the nibs A1, A5, A9, . . . can be driven, in sub line 3, nibs B2, B6, B10, . . . can be driven and finally in sub line 4 the nibs B3, B7, B11, . . . can be driven. In fact, all kind of configurations can be considered when composing sub lines, but in the end all the pixel areas on that line will have been printed.

One reason for using sub lines is based on the limitation of the control electronics. There can, however, be other reasons, not based on limitations of the electrical system. For example one can introduce some waiting time between the sub lines with the purpose of having a small cooling period. This diminishes the cross-talk effect between the heater elements having printed in the past, and the heater elements that will be printing in the near future. Because of parasitic heat coming from one nib and flowing to the others, a small waiting period can give a sufficient reduction to the nib temperature producing in that case no fog on the image forming material. Also, when compensation is not possible, a short waiting period can make an uncompensated pixel acceptable.

Of course, the big disadvantage of working with sub lines is twofold:

Firstly, one can get interactions with the medium transport, as the longer it takes to print a whole line, the more difficult it will be to align all the pixels correctly without the creation of Moiré effects.

Furthermore, whenever sub lines are used, the parasitic heat from the former sub lines printed during that line time will influence the sub lines still to be printed in that line. Also, heat tends to spread relatively fast, which means that the cross-talk can extend over several nibs. In some cases, waiting periods in between the sub lines will not sufficiently reduce this cross-talk, so one must use compensation techniques to get equal outputted densities or pixel sizes.

Also, in practice, in order to increase the controllability of the energy delivered to every addressable heater element, it is preferable to use a series of time slices, every time slice representing a quantified amount of energy that is being delivered to the heater element (e.g. explained in U.S. Pat. No. 5,786,837). The more time slices, the more resolution is available to drive every heater element. In practice, this will enlarge the total time necessary for printing a sub line and this increase in time will increase the cross-talk between the active nibs, despite the increased controllability of every heater element energy. This increased cross-talk effect will be found in more pronounced Moiré effects on the graphical output.

It is shown hereinafter why is it preferable to have equal sized nibs. A picture is considered that is being printed and which consists of simple vertical lines, as represented in FIG. 3. Each line is one pixel or d micrometers wide, and the lines are printed with a periodicity τ. When performing a macro density measurement on FIG. 3, the density measured will theoretically be given by:

$$D = \log_{10}\left(\frac{\tau}{\tau - d}\right). \qquad \text{Eq. (1)}$$

Experiments show that if two such line patterns are glued to each other, a continuous blend can be formed when the density jump from one line pattern to the other is smaller or equal to 0.03 variation in the density scale. This corresponds to a change of line thickness that can be found by a Taylor series expansion of Eq.(1):

$$\Delta D = \frac{1}{\ln(10)(\tau - d)}\Delta d = 0.434\frac{d}{\tau - d}\delta d. \quad \text{Eq. (2)}$$

When taking a value of ΔD=0.03 and for τ=84.6 μm, d=50 μm for a 600 dpi system, then the variation on the width d of the line, or thus the variation on the pixel size is δd=4.7%, being normally a rather difficult constraint. Of course, this is only an example and for every case, the system requirements must be re-evaluated, but it illustrates that an accurate control of pixel size can be mandatory.

A print process is considered where $N_s$ sub lines are being used for printing a single line. The time between every sub line is $t_{ss}$ and is assumed now, as an example only, to be a constant, although the theory can easily be extended for non constant inter sub line times, making it of course more complex. Whenever a pixel is printed in sub line number r, it's heat will give cross-talk to the nibs being printed in the following sub lines. So, a pixel printed on the first sub line will be able to give cross-talk to all the nibs in the neighbourhood, printed in the remaining sub lines. This process of cross-talk will be expressed in the present document using the notice of the "pixel response" function for a printed pixel.

During the process of printing a full line, the thermal system can be considered as being a linear system, this is that the thermal properties (ρ,$\bar{\lambda}$,c) of the system will remain constant (this is not a function of time). The thermal system is then fully described by $$\rho c\frac{\partial T}{\partial t} = div(\bar{\lambda}\cdot grad(T)) + q(\vec{r}, t). \quad \text{(Eq. 3)}$$

Because of the linearity of the div and grad operators, the superposition principle does apply. This means that if $q_1(\vec{r},t)$ gives a solution $T_1(\vec{r},t)$ and $q_2(\vec{r},t)$ gives a solution $T_2(\vec{r},t)$, then $a\cdot q_1(\vec{r},t)+b\cdot q_2(\vec{r},t)$ will give a solution $a\cdot T_1(\vec{r},t)+b\cdot T_2(\vec{r},t)$, with $a,b \in \Re$, being real numbers. It is to be noted that this superposition relation is as well valid in the time domain as in the spatial $\vec{r}$ domain, provided that the film material is not moving relative to the heater elements.

The above sentences can be reformulated into a more macroscopic view. If a pixel A and a pixel B are printed, then the thermal state of the system will be of that kind that it equals the summation of the thermal states produced by that of pixel A and that of pixel B separately. This is simply because of the superposition principle. It is a prerequisite that the image forming medium keeps the same physical position under the thermal head when applying the superposition principle. This is certainly the case when considering the temperature in the image forming layer.

The superposition principle applies for the thermal system in the printer and will be correct for the temperature distribution in the image forming material, but it does not apply to the graphical output, because the image forming process itself is nonlinear, excluding every use of linear superposition and convolution.

But if there is started from the view point of compensation, the aim of compensation is to be able to reproduce the same pixel under all circumstances. That means that for different circumstances, one will try to reproduce a temperature image in the graphical material, that is the same under all circumstances, e.g. have a pixel A and a pixel B, one aside the other. When printing pixel A in sub line 1 with nib A and printing pixel B in sub line 2 with nib B, the heat of sub line 1 generated for printing pixel A can be superimposed on the heat produced in the second sub line for printing pixel B. When the compensation algorithm is correct, pixel B will receive a smaller amount of heat, to compensate for the heat already present from printing pixel A. In the end, the image forming material will see the same amount of heat coming from nib B, regardless of whether nib A was on or off. In that case, the same graphical output is obtained, although the graphical process itself is non linear. In fact, when the input of a non linear system is under all circumstances the same, the output also will be the same.

The use of a compensation technique will never be able to enforce an identical temperature pattern under nib B regardless of the printing with nib A or not. When this is the input to a non-linear system, the graphical output will be different, simply because the time history (slicing scheme) of the input is different. In practice, the cross-talk heat generated by nib A is not that large, so that we can speak from a considerable offset temperature being present when starting to print nib B. The graphical output of pixel B will not be the same in case nib A has printed or not, but from a graphical point of view, the compensation can be adapted to give an equal weighted graphical output, showing the same density or the same pixel size.

The amount of thermal energy in the image forming material (or the temperature) can be expressed by an equivalent excitation time $t_e$ [μs]. This means that the same temperature can be reached in the image forming material by starting from a cold nib (at a reference temperature $T_{ref}$) and then applying excitation to the nib with a time $t_e$ specified to the slicer algorithm. The nib itself will be excited during a time $t_{exc}$, being numerically different from $t_e$. The relation between $t_e$ and $t_{exc}$ is schematically shown in FIG. 4. But from the viewpoint of the controller, the exact value of $t_{exc}$ is not important. It is the slicer's duty to realize a virtual $t_e$ value so that it looks for the controller as if it were working with a linear printing process. Details concerning a slicer construction can be found in EP-1234677.

This leads to a concept of impulse response of a pixel printed during a certain sub line r. For a nib being far from the edges of the thermal head, when starting with a cold nib at $T_{ref}$ and then applying an excitation time $t_e$ to the nib, a few percent of the heat can be found in the neighbouring nibs in the same and in all the following sub lines. This is expressed using a system of constants according to Table 1.

TABLE 1

| Sub line | . . . | x − 3 | x − 2 | x − 1 | nib x | x + 1 | x + 2 | x + 3 | . . . |
|---|---|---|---|---|---|---|---|---|---|
| r | $\xi_i$ | $\xi_3$ | $\xi_2$ | $\xi_1$ | 1 | $\xi_1$ | $\xi_2$ | $\xi_3$ | $\xi_i$ |
| r + 1 | $\alpha_i$ | $\alpha_3$ | $\alpha_2$ | $\alpha_1$ | $\alpha_0$ | $\alpha_1$ | $\alpha_2$ | $\alpha_3$ | $\alpha_i$ |
| r + 2 | $\beta_i$ | $\beta_3$ | $\beta_2$ | $\beta_1$ | $\beta_0$ | $\beta_1$ | $\beta_2$ | $\beta_3$ | $\beta_i$ |
| r + 3 | $\gamma_i$ | $\gamma_3$ | $\gamma_2$ | $\gamma_1$ | $\gamma_0$ | $\gamma_1$ | $\gamma_2$ | $\gamma_3$ | $\gamma_i$ |
| r + 4 | $\delta_i$ | $\delta_3$ | $\delta_2$ | $\delta_1$ | $\delta_0$ | $\delta_1$ | $\delta_2$ | $\delta_3$ | $\delta_i$ |
| r + 5 | . . . | . . . | . . . | . . . | . . . | . . . | . . . | . . . | . . . |

The idea of writing the heat distribution of a single printed pixel to the other neighbouring pixels is known e.g. from "11th Annual Thermal Printing Conference", May 10–12, 2000, Chaparral Suites Hotel, Scottsdale, Ariz., USA and is based on the convolution theorem for linear systems. In fact, the concept of impulse response in applied to a dirac input function. In the present case, the input function is not a Dirac function, but a normal nib excitation over a time $t_e$. Abstraction should be made from this time $t_e$ as it is a time used by the controller, but the head drive controller will use a lookup table and a slicer algorithm to realise this time $t_e$. There will be a relationship between the mathematical impulse response and the macroscopic pixel response. If $h(\vec{r},t)$ represents the distribution of heat in the image forming material (and/or the thermal head) for a nib excited with an amount of energy $\delta(t)$ [J], then for a random nib excitation q(t) [J], the heat distribution in the image forming material (and/or thermal head) is given by the convolution theorem:

$$T(\vec{r},t)=q(t)\otimes h(\vec{r},t) \qquad \text{Eq.(4)}$$

and is principally only a convolution in the time domain, not in the space domain. The excitation q(t) comes from the slicer algorithm and is defined for every given requested nib excitation time $t_e$.

It is to be noted that the above expression is in the temperature domain. There will be a relationship between the temperature domain and the $t_e$ domain. For this, it is necessary for every nib to calculate a representative temperature value in the thermal sensitive material under the nib when being excited with a $t_e$ value. This is e.g. a mean temperature value or a complicated function taking into account the thermographic characteristics of the image forming medium. As an example, the maximum mean temperature value will be used, only for the sake of explaining this matter.

$$T_{pixel}(t_e)=\max\left[\oiint_{pixel}\int T(\vec{r},t)dtdV\right]. \qquad \text{Eq. (5)}$$

So, for every $t_e$ value, it is possible to find for that nib a representative thermal state $T_{pixel}$ that has a direct relationship with the graphical output.

The construction of Table 1 can theoretically be done using numerical techniques. For a certain excitation time $t_e$, the temperature distribution can be calculated in the thermal head, including the image forming material. Only one nib must be excited with this value and during the simulation the correct slicer pattern must be used. The simulation must comprise all sub lines and the correct timing between the different sub lines must be used, even when they are not equally spaced in time. For the considered generated pixel, the value of the representative thermal state $T_{pixel}$ can be calculated for all pixels and for all sub lines. By dividing all values by $T_{ref}(t_e)$ of the pixel found at the very first calculated sub line, one gets all values relative to the pixel written. In this way, the pixel response has been found, giving the contribution of temperature from one pixel excited, to all the other pixels in the thermal head. Also, the contribution of heat of the pixel itself can be found in the direct neighbouring nibs at the sub line itself where the pixel is printed (these are the constants $\xi_i$ in Table 1).

In practice, one does not need to refer to complicated numerical calculation schemes to find the coefficients of the pixel response. There can be started from a hypothetical pixel response matrix, a compensation scheme based on the chosen pixel response matrix can be built and then based on experiments, the cross-talk will be compensated by trying 'some' numerical value for the given coefficient, smaller than 1 and greater than zero. When compensations goes well for a certain coefficient, then the correct coefficient has been found. This will be explained more in detail later on.

The size of the pixel response is normally limited: as the heat tends to spread in a range of several milliseconds, mostly only the direct neighbours will be affected by cross-talk. So in the horizontal sense, the pixel response will be limited. In the sub line direction, the limitation comes most often from the number of sub lines itself, as too many sub lines is difficult to combine with a fast transport rate of the thermographic medium and as it normally gives too large line times, being economically unacceptable.

When printing pixels on a line, even sized pixels can be realized by printing them all with the same excitation time $t_e$. Whenever there is cross-talk between nibs, one printed nib will transfer a small amount of its heat to some other nib. If the first nib is printed with a value $t_e$, and if the transfer coefficient of the heat to a second nib is e.g. $\alpha$, then the second nib will receive an amount of heat of the first nib equal to $\alpha t_e$. Printing this nib then only requires an amount of excitation time equal to $(1-\alpha)t_e$.

The above process can also be explained by the concept of latent heat. When printing a nib, one has to look how many heat is latently available in that nib due to the cross-talk from other nibs. One has to realize in total an excitation time $t_e$, so, all excitation time that is already present under the form of latent heat, must not be supplied when driving the nib.

The printing process using several sub lines can be regarded as a process of creating latent heat in every sub line that has to be coped with in the following sub lines to be printed. It is numerically not difficult to calculate the latent heat that will be present at the start of a sub line. Whenever the pixel transfer function is known (all of its coefficients), by making simple multiplications and additions, the latent heat in every sub line, generated by the older sub lines in the same line, can be calculated.

Up to now, the discussion has been limited to the sub lines and their interaction. When printing lines, the time span between the lines will be limited, so that still some heat of one line will be present in the other lines. Again, the concept of pixel response can be used, but must now be redefined on a line to line basis. In this case, one can make abstraction of the sub lines used for printing a line. For a single pixel printed, one can calculate again what will be the latent heat in the next lines to come and also for all the neighbours of this pixel. This concept is also described in U.S. Pat. No. 5,793,403 and is not the subject of this invention.

The invention here described gives a method to do compensation when printing the several sub lines in a line having cross-talk between pixels being printed in the same sub line. Although sub line printing could be interpreted as sequentially printing several lines without medium movement, this is not fully true. Adjacent pixels will interact with each other because the heat transport from one to the other is so fast that they will influence each other. This is certainly the case when the sub line time is taken large in order to improve the controllability of the printing process using more time slices.

Given a line to be printed with a certain image information that has been transformed to a vector of wanted pixel excitations $\{t_n^{wanted}\}$, n=0, . . . , $N_{nibs}-1$. $N_{nibs}$ is the total number of pixels on the line. Whenever no pixel is printed, its value will be set to zero, in the other case its value will be a constant $t_{ref}$ or $t_{ref}$ corrected with some correction factor.

As the slicer will extend the print job over several sub lines r, for every sub line it is necessary to give a more precise definition of what pixel temperature is desired. Therefore, we extend the vector $\{t_n^{wanted}\}$ to a more precise definition telling for every sub line what the corresponding pixel temperature must be: $\{t_{r,n}^{wanted}\}$, with r the sub line number, $r=0, \ldots, N_s-1$.

The pixel excitation times $t_e$ are at this moment unknown and will be represented by the vector $\{t_n^e\}$, again $n=0, \ldots, N_{nibs}-1$. The slicer will distribute this line information over the several sub lines r. For the formulation, it is important to have knowledge where a certain nib will be excited or not. Therefore, the vector $\{t_n^e\}$ is reformulated to an extended version giving the pixel excitation information in every sub line: $\{t_{r,n}^e\}$, r is the sub line number ranging from $r=0, \ldots, N_s-1$.

It is assumed that the pixel transfer function matrix H is known (refer to Table 1). In Table 1, Greek letters are used to denote the different coefficients of the pixel transfer function. This notation is very useful when working with a practical example, as then every coefficient has to be determined experimentally. In the present case, a more general notation will be used, making the formula expressions more easy to write in the most global situation.

Let $H_{r,k}$ be the pixel response function, with the r-index the number of the sub line and k the neighbour nib number. $H_{0,0}$ will be equal to 1. Rewriting Table 1 with this new notation gives the following result:

TABLE 2

| Sub line | . . . | x − 3 | x − 2 | x − 1 | nib x | x + 1 | x + 2 | x + 3 | . . . |
|---|---|---|---|---|---|---|---|---|---|
| 0 | $H_{0,k}$ | $H_{0,3}$ | $H_{0,2}$ | $H_{0,1}$ | $H_{0,0}=1$ | $H_{0,1}$ | $H_{0,2}$ | $H_{0,3}$ | $H_{0,k}$ |
| 1 | $H_{1,k}$ | $H_{1,3}$ | $H_{1,2}$ | $H_{1,1}$ | $H_{1,0}$ | $H_{1,1}$ | $H_{1,2}$ | $H_{1,3}$ | $H_{1,k}$ |
| 2 | $H_{2,k}$ | $H_{2,3}$ | $H_{2,2}$ | $H_{2,1}$ | $H_{2,0}$ | $H_{2,1}$ | $H_{2,2}$ | $H_{2,3}$ | $H_{2,k}$ |
| 3 | $H_{3,k}$ | $H_{3,3}$ | $H_{3,2}$ | $H_{3,1}$ | $H_{3,0}$ | $H_{3,1}$ | $H_{3,2}$ | $H_{3,3}$ | $H_{3,k}$ |
| 4 | $H_{4,k}$ | $H_{4,3}$ | $H_{4,2}$ | $H_{4,1}$ | $H_{4,0}$ | $H_{4,1}$ | $H_{4,2}$ | $H_{4,3}$ | $H_{4,k}$ |
| r | $H_{r,0}$ | $H_{r,1}$ | $H_{r,2}$ | $H_{r,1}$ | $H_{r,0}$ | $H_{r,1}$ | $H_{r,2}$ | $H_{r,3}$ | $H_{r,k}$ |

The H-matrix is symmetrical, this means that nibs at position x+k will see the same heat as the nibs at position x−k.

When printing a complete pixel line, the resulting total pixel temperature or equivalent steering time $t_{r,n}^{total}$ for a pixel at sub line r and position n is given by:

$$t_{r,n}^{total} = \sum_{j=0}^{r}\left[\sum_{i=0}^{n} t_{r-j,n-i}^{e} H_{j,i} + \sum_{i=1}^{N_{nibs}-1-n} t_{r-j,n+i}^{e} H_{j,i}\right] + t_r^{add} \quad \text{Eq. (6)}$$

When j equals 0, all the terms $H_{0,i}$ contributing to $t_{r,n}^{total}$ are present. This is a direct cross-talk effect by rapid heat spreading in the thermal head. The values of j going from 1 to r gives terms that represent the latent heat from all the nibs printed in the prior sub lines.

The presence of the term $t_r^{add}$ is to be noted, which is an additional term and represents the heat produced in nib n due to the zero-excitation energy from all the other nibs and integrating as well the effect (0-excitation energy) of the former sub lines. Some thermal head constructions have the property that heater elements not being addressed during an active strobe time, still deliver some fixed amount of energy (e.g. U.S. Pat. No. 5,702,188). It is only assumed that this parasitic off-switched heat generation during the printing process is the same for all the nibs. In that case, this heat generation can be bundled into a single constant, being different for each sub line. For the first sub line, $t_0^{add}$ can be taken equal to zero. This is just a matter of references.

The above expression assumes that at the physical ends of the thermal head, the thermal structure simply continues (without being equipped with nibs). In most cases, the structure of the thermal head simply ends, forming an isolation barrier for the heat transport. This can be modelled mathematically by creating a line of thermal symmetry at both ends of the thermal head. One can imagine that another head is placed directly behind the end of the current head with a nib excitation that is symmetrical to the considered head. This creates in fact a virtual reflection of heat transfer, as the heat that flows past the ends of the heads, enters immediately again as virtually coming from the mirrored head. In that case, Eq.(6) can be rewritten:

$$t_{r,n}^{total} = \sum_{j=0}^{r}\left[\sum_{i=0}^{N_{nibs}-1} t_{r-j,\zeta}^{e} H_{j,i} + \sum_{i=1}^{N_{nibs}-1-n} t_{r-j,\eta}^{e} H_{j,i}\right] + t_r^{add} \quad \text{Eq. (7)}$$

with $\zeta=|n-i|$ and if $(n+i)>(N_{nibs}-1)$ then $\eta=2(N_{nibs}-1)-n-i$, else $\eta=n+i$.

In most cases, the coefficients of H can be neglected when the i-index becomes large, i.e. for nibs far away from the excited nib. For example for a thermal head under test, for i greater than 3, all the H-coefficients where zero. In that case, only small errors are made by only considering Eq.(6) and not Eq.(7). Errors happen only at the outer ends of the printable region, so they are in most cases not visible. Also, some more complicated boundary conditions can exist at the end of a thermal head, making the assumption of a thermal symmetry plane not very credible. A more correct modelling can be looked for, but again, because of the limited H-span, only small errors will be present at the thermal head boundary, so that again Eq.(6) will do the job.

As an expression for the obtained pixel values $t_{r,n}^{total}$ has now been settled, they are put equal to the required pixel reference time $t^{ref}$, this in order to get an equal pixel size or equal density size output. In that case:

$$t_{r,n}^{total}=t^{ref}, \text{ for } r=0, \ldots, N_s-1 \; n=0, \ldots, N_{nibs}-1 \quad \text{Eq.(8)}$$

In total, there are $N_s \times N_{nibs}$ unknown excitation times, but an equal amount of equations (Eq.(6), Eq.(7)) can be written, allowing in theory to solve for the unknowns $\{t_{r,n}^e\}$. This is an embodiment of the invention.

Now some special technique will be added, called relaxation, being also an embodiment of the invention.

As a summary, the unknown excitation times for the nibs can be found by solving the system of equations:

$$t_{r,n}^{wanted} = \sum_{j=0}^{r}\left[\sum_{i=0}^{n} t_{r-j,n-i}^{e} H_{j,i} + \sum_{i=1}^{N_{nibs}-1-n} t_{r-j,n+i}^{e} H_{j,i}\right] + t_r^{add}, \quad \text{Eq. (9)}$$

$$r = 0, \ldots, N_s - 1 \quad n = 0, \ldots, N_{nibs} - 1.$$

Mathematically, this system will have a determinant different from zero and there will be an exact mathematical solution. Unfortunately, many terms in the vector $\{t_{r,n}^{wanted}\}$ will be zero. The corresponding excitation term $t_{r,n}^e$ is also expected to be zero, but in practice, mathematically it will be negative. Indeed, as $t_{r,n}^{wanted}$ has to be zero, the mathematics will find a value for $t_{r,n}^e$ so that this will be realized. It is known that a lot of latent heat will flow into the pixel, so, to make it zero, some heat has to be extracted, or in physical terms: the nib has to be cooled below the reference temperature. This is practically impossible. So, the mathematical solution from Eq.(9) cannot physically be realized. One solution would be to drop all excitation times, which are smaller than zero, so the slicer can do this job. However, the solution thus found will be far from perfect and the final pixel temperatures will be quite different from the requested ones at the picture edges.

A solution has to be found. It does not make any sense to put $t_{r,n}^{wanted}$ zero whenever no graphical output is requested for that pixel. The best thing one can do is take $t_{r,n}^{e}$ equal to zero. This is illustrated now with an example.

A system with 3 nibs being printed in a single sub line is considered. For the first sub line the additional time $t_0^{add}$ can be taken zero. The pixel response matrix will be a single rowed matrix:

$$H=[1h_1h_2h_3]. \quad \text{Eq.(10)}$$

The system of equations is derived from Eq.(9):

$$\begin{bmatrix} t_0^e + h_1t_1^e + h_2t_2^e + h_3t_3^e \\ h_1t_0^e + t_1^e + h_1t_2^e + h_2t_3^e \\ h_2t_0^e + h_1t_1^e + t_2^e + h_1t_3^e \\ h_3t_0^e + h_2t_1^e + h_1t_2^e + t_3^e \end{bmatrix} = \begin{Bmatrix} t_0^{wanted} \\ t_1^{wanted} \\ t_2^{wanted} \\ t_3^{wanted} \end{Bmatrix}. \quad \text{Eq. (11)}$$

In case it is desired to print the pixel pattern {1,0,1,1}, the wanted values for our pixels are known:

$$\begin{Bmatrix} t_0^{wanted} \\ t_1^{wanted} \\ t_2^{wanted} \\ t_3^{wanted} \end{Bmatrix} = \begin{Bmatrix} t_{ref} \\ 0 \\ t_{ref} \\ t_{ref} \end{Bmatrix}. \quad \text{Eq. (12)}$$

Now the important point is not to set $t_1^{wanted}$ equal to zero, but $t_1^e$. In fact, the best way not to print a pixel at a certain position is by not exciting that corresponding nib. For this particular case, Eq.(11) is rewritten as follows:

$$\begin{bmatrix} t_0^e + 0 + h_2t_2^e + h_3t_3^e \\ h_1t_0^e + 0 + h_1t_2^e + h_2t_3^e - t_1^{wanted} \\ h_2t_0^e + 0 + t_2^e + h_1t_3^e \\ h_3t_0^e + 0 + h_1t_2^e + t_3^e \end{bmatrix} = \begin{Bmatrix} t_{ref} \\ 0 \\ t_{ref} \\ t_{ref} \end{Bmatrix}. \quad \text{Eq. (13)}$$

One of the unknowns has been eliminated, so a reduced system of equations is obtained:

$$\begin{bmatrix} t_0^e + h_2t_2^e + h_3t_3^e \\ h_2t_0^e + t_2^e + h_1t_3^e \\ h_3t_0^e + h_1t_2^e + t_3^e \end{bmatrix} = \begin{Bmatrix} t_{ref} \\ t_{ref} \\ t_{ref} \end{Bmatrix}. \quad \text{Eq. (14)}$$

Once this system of equations is solved, $t_1^{wanted}$ can be calculated:

$$t_1^{wanted}=h_1t_0^e+h_1t_2^e+h_2t_3^e, \quad \text{Eq.(15)}$$

and in fact represents the parasitic heat generated by the other nibs in that node.

As a conclusion, whenever a pixel must be zero (or not printed), it's excitation time must be taken zero and it can be excluded from the system of equations, e.g. Eq.(9). Whenever many pixels are not printed, the smaller will be the system of equations. This looks easy, but in fact it is not. When the system of equations is solved numerically, this must be done in real time and therefore implies some constraints on the mathematics to be done. One of these is that making decisions during a calculation slows down the calculation. This is because of the pipelining used in many high speed microprocessors like DSP's (digital signal processors). The pipeline has to be emptied depending on the value of the boolean decision and this costs CPU cycles that are wasted. Also, the overhead involved when setting up the system of equations depending on the image data can be very time consuming and complex. In that case, another approach might be relaxation, as explained hereinafter.

It can be beneficial, regarding the real-time aspect, to keep a fixed system of equations. In that case, one can a priori calculate how long it takes to solve, being now independently of the image information.

The idea is to give a value to $t_{r,n}^{wanted}$ that naturally will be present during the printing process when printing that nib with a value $t_{r,n}^{e}=0$. All the negative terms will disappear from $\{t_{r,n}^{e}\}$ and all the values of $\{t_{r,n}^{wanted}\}$ which are different from zero (implying a graphical output) will be correctly realized.

The calculation of the $t_{r,n}^{wanted}$ values for the pixels that are not excited is also computational demanding, but in most cases, it are many multiply accumulate operations that can be done fairly fast on DSP hardware.

Relaxation is in fact built on an iteration process. One has to now the temperature of a pixel that is produced by the cross-talk effect coming from the other pixels. In order to know this cross-talk, the excitation of these nibs must be known, something which is not true a priori. Relaxation is then built on supposing an a priori solution, calculating cross-talk and then finding the $t_{r,n}^{wanted}$ value for the non printed pixels which are being printed in the considered sub line. The system of equations can be solved, giving new values of $t_{r,n}^{e}$ which can be re-used for a new cross-talk calculation, etc. . . . until a result is found which is accurate enough. This will be explained with an example.

Again, the system of equations of the numerical example in the former paragraph is taken:

$$\begin{bmatrix} t_0^e + h_1t_1^e + h_2t_2^e + h_3t_3^e \\ h_1t_0^e + t_1^e + h_1t_2^e + h_2t_3^e \\ h_2t_0^e + h_1t_1^e + t_2^e + h_1t_3^e \\ h_3t_0^e + h_2t_1^e + h_1t_2^e + t_3^e \end{bmatrix} = \begin{Bmatrix} t_0^{wanted} \\ t_1^{wanted} \\ t_2^{wanted} \\ t_3^{wanted} \end{Bmatrix}. \quad \text{Eq. (11)}$$

and the image information is:

$$\begin{Bmatrix} t_0^{wanted} \\ t_1^{wanted} \\ t_2^{wanted} \\ t_3^{wanted} \end{Bmatrix} = \begin{Bmatrix} t_{ref} \\ 0 \\ t_{ref} \\ t_{ref} \end{Bmatrix}. \quad \text{Eq. (12)}$$

$t_1^{wanted}$ will not be put equal to zero, but in a first approximation equal to:

$$t_1^{relax}=h_1t_{ref}+h_1t_{ref}+h_2t_{ref} \quad \text{Eq.(16)}$$

The following system of equations is then solved:

$$\begin{bmatrix} t_0^e+h_1t_1^e+h_2t_2^e+h_3t_3^e \\ h_1t_0^e+t_1^e+h_1t_2^e+h_2t_3^e \\ h_2t_0^e+h_1t_1^e+t_2^e+h_1t_3^e \\ h_3t_0^e+h_2t_1^e+h_1t_2^e+t_3^e \end{bmatrix} = \begin{Bmatrix} t_0^{wanted} \\ t_1^{relax} \\ t_2^{wanted} \\ t_3^{wanted} \end{Bmatrix} \quad \text{Eq. (17)}$$

The result vector will be written as:

$$\begin{Bmatrix} t_0^{iter1} \\ t_1^{iter1} \\ t_2^{iter1} \\ t_3^{iter1} \end{Bmatrix}. \quad \text{Eq. (18)}$$

Now again new relaxation values can be calculated for the pixels not being printed, by taking Eq.(16) again:

$$t_1^{relax2}=h_1t_0^{iter1}+h_1t_2^{iter1}+h_2t_3^{iter1}. \quad \text{Eq.(19)}$$

With these newly relaxed values, one can step to Eq.(17) and make another iteration.

In the end, a correct solution will be obtained. For a certain H-matrix, the number of iterations can be fixed a priori, depending on the error that is allowed in the solution. In most cases, one or two iterations will give sufficient accuracy to the solution.

The above theory assumes that the coefficients of the H-matrix are known. In reality, they can only be found on an a posteriori basis. The whole system of equations is to be set up based on coefficients given e.g. a zero value. On an experimental base, the H-coefficients can then be found, as a correct chosen H-value will give a correct compensation and accordingly a correct graphical output.

It is assumed that the system is defined by an H-matrix:

$$H=\begin{bmatrix} 1 & h_{01} & h_{02} & 0 \\ h_{10} & h_{11} & h_{12} & 0 \\ h_{20} & h_{21} & h_{22} & h_{23} \\ h_{30} & h_{31} & h_{32} & h_{33} \end{bmatrix} \equiv \begin{bmatrix} 1 & \zeta_1 & \zeta_2 & 0 \\ \alpha_0 & \alpha_1 & \alpha_2 & 0 \\ \beta_0 & \beta_1 & \beta_2 & \beta_3 \\ \gamma_0 & \gamma_1 & \gamma_2 & \gamma_3 \end{bmatrix}. \quad \text{Eq. (20)}$$

Also an additional time vector is given:

$$\{t^{add}\}=\begin{Bmatrix} 0 \\ t_1^{add} \\ t_2^{add} \\ t_3^{add} \end{Bmatrix}, \quad \text{Eq. (21)}$$

representing zero-pixel latent energy transferred to the following sub line(s), being for the moment unknown!

It can be noticed from Eq.(20) that some of the coefficients in the H matrix have been taken zero. Because of physical grounds, they are never exactly equal to zero, but their value might be that small that no physical interaction can be found in the graphical output. In that case, it is best to put them zero. If not taken zero from the beginning, during the process of finding these coefficients, one would automatically find them to have a zero value.

One must build a clear conceptual image of how the pixels are being printed during a line time. As there are in the example four sub lines, in one way or another, the pixels will be distributed over these four sub lines. The way this is done depends on many factors, like hardware possibilities, methods for counteracting cross-talk etc. . . . , and it is assumed that this is a choice of the designer and thereby known.

Up to now, abstraction has been made of the real numerical values defined in Eq.(20) and Eq.(21). Now it will be considered how these constant numbers can be determined.

As there is dealt with constants, the controller of the printing device can fully be developed taking into account that the value of these coefficients should be user selectable (at run-time or at compile time, requesting of course successive recompilation). Although being unknown, they can always be taken 0, giving in fact an uncompensated printing device.

All coefficients need to be determined based on experiments, by comparing an individual pixel with itself and adjusting the coefficient until an equal sized printout is obtained. Sometimes, this can demand functionality from the controller that does not need to be installed whenever making a standard printout.

In a first step, the $t_r^{add}$ coefficients are determined. The $t^{add}$ has to make a pixel printout in the sub line r identical to a pixel printed in the other sub lines, given that the pixel is printed without any neighbours (or in fact excluding the effect from the other cross-talk coefficients). The constant $t^{0add}$ can be taken zero, meaning in fact that a pixel with index 4*i* is the reference in our printing scheme. When printing an isolated 4*i*+1 pixel, it should be made equal sized to the 4*i* pixel by adjusting the coefficient $t_1^{add}$. This can practically be done be e.g. the following printing pattern (each row in the matrix is a line, consisting itself of $N_s$ sub lines):

$$\text{Pattern 1:} \begin{bmatrix} 0 & 0 & 0 & 0 & 1_{4i} & 0 & 0 & 0 & 0 & 0 & 0 & 0 \\ 0 & 0 & 0 & 0 & 0 & 0 & 0 & 0 & 0 & 0 & 0 & 0 \\ 0 & 0 & 0 & 0 & 0 & 1_{4i+1} & 0 & 0 & 0 & 0 & 0 & 0 \\ 0 & 0 & 0 & 0 & 0 & 0 & 0 & 0 & 0 & 0 & 0 & 0 \end{bmatrix}.$$

Each time an empty line is between the two lines to be sure that the pixels will not overlap. It is preferred to exclude any of the 4*i* pixel's latent heat when printing the 4*i*+1 pixel. The best way to do this is using a very long waiting before printing a new line, giving the latent heat enough time to flow away.

A better approach consists of the following pattern:

$$\text{Pattern 2:} \begin{bmatrix} 0 & 0 & 0 & 0 & 1_{4i}|_{r=0} & 0 & 0 & 0 & 0 & 0 & 0 & 0 \\ 0 & 0 & 0 & 0 & 0 & 0 & 0 & 0 & 0 & 0 & 0 & 0 \\ 0 & 0 & 0 & 0 & 1_{4i}|_{r} & 0 & 0 & 0 & 0 & 0 & 0 & 0 \\ 0 & 0 & 0 & 0 & 0 & 0 & 0 & 0 & 0 & 0 & 0 & 0 \end{bmatrix}.$$

Here, on the first line the 4*i* pixel is printed in sub line 0, but on the other line, the same pixel is printed in another sub line r≠0. By adjusting the corresponding $t_r^{add}$ value, the pixel should be made equal sized or equal dense to the reference pixel when printed in sub line 0. Comparing the same pixel with itself has the benefit that there is no interference with mechanical print differences between several nibs, being present because of constructional fabrication differences.

In a second step, the cross-talk coefficients (Table 2) are determined. As the pixel data is distributed over the several sub lines when printing a single line, only those coefficients must be considered in a sub line where actual pixel data is being printed. So $H_{i,j}$ is important when in sub line i, the j-th or -j-th neighbour is printed. For every cross-talk coefficient $H_{i,j}$ at least one printing pattern can be defined where the coefficient $H_{i,j}$ will be the only coefficient active in the printing process. Again, a pixel has to be compared with itself and the value of the coefficient $H_{i,j}$ is adapted until the pixel becomes equal sized or equal dense. When making the printouts, the values of the other coefficients don't need to be taken 0, meaning that for these cross-talks effects, the compensation can be active, although it will have no influence on the current printing process.

Also, now the $\{t^{add}\}$ values need to be correct as pixels are being printed in their own sub line and the $t_r^{add}$ coefficient will be active.

Figure 7:
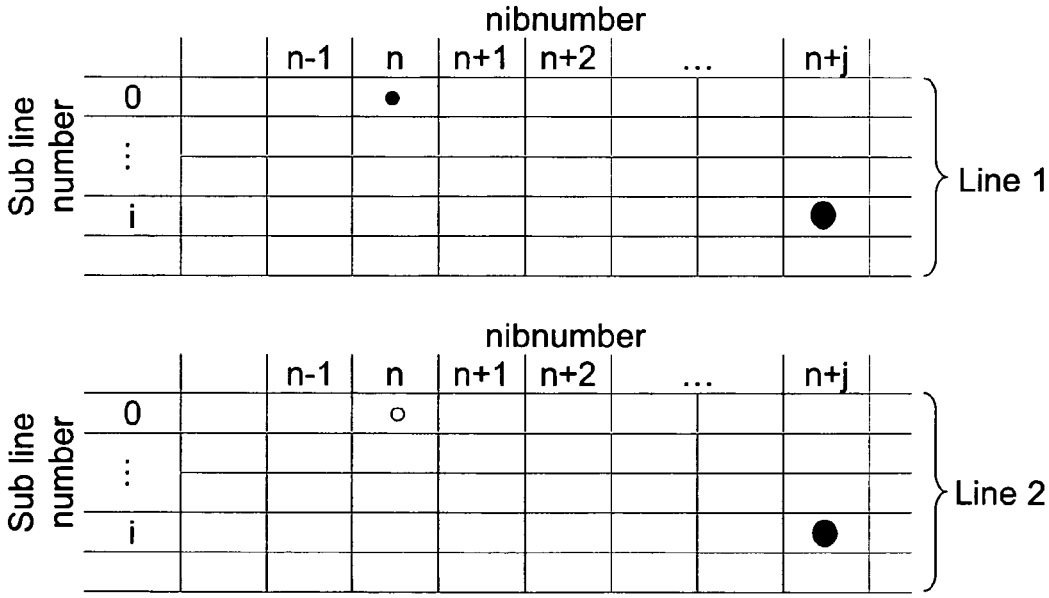
FIG. 7 illustrates the influence of the heat transfer coefficient $H_{i,j}$ (i is sub line number, j relative neighbour number) by printing 2 distinct lines, a first line with pixels at nib n and n+j and a second line with only a pixel at nib n+j. Correct tuning of $H_{i,j}$ in the deconvolution algorithm according to the present invention should make the pixel at line 1 equal size or equal dense as in line 2, which serves in this case as a reference.

This can be illustrated with a print pattern for observing the effect of the coefficient $H_{i,j}$ as is depicted in FIG. 7. As shown in FIG. 7, two distinct lines are printed, each in a number of sub lines. A first line, line 1, has printed pixels, represented by the black dots, at nib n and at nib n+j. A second line, line 2, has only a printed pixel, represented by a black dot, at nib n+j. Nib n is not excited, which is represented by a white dot. Correct tuning of $H_{i,j}$ in the deconvolution algorithm according to the present invention should make the pixel generated by nib n+j at line 1 equal size or equal dense as the pixel generated by nib n+j in line 2, which serves in this case as a reference.

EXAMPLE

A thermal head has a plurality of nibs with nib numbers $\{0, 1, 2, 3, 4, \ldots, i, i+1, i+2, i+3, i+4, \ldots, N_{nibs}-1\}$. One line is printed in two sub lines. In sub line 0, all pixels with index or nib numbers 4*i* and 4*i*+2 are being printed; in sub line 1, all pixels with index 4*i*+1 and 4*i*+3.

For this particular case all equations can be written down with reference to Eq.(20). As these equations will be elaborated on, the Greek notation of the H-matrix coefficients has been taken. Nibs never excited in a sub line are not included in the equations, but nibs excited in a sub line are always included in the equation, what ever might be its pixel value.

For sub line 0:

$$t_{4i}^{nib}=t_{4i}^{e}+\zeta_2 t_{4i-2}^{e}+\zeta_2 t_{4i+2}^{e}. \quad \text{Eq.(22)}$$

and $$t_{4i+2}^{nib}=t_{4i+2}^{e}+\zeta_2 t_{4i}^{e}+\zeta_2 t_{4i+4}^{e} \quad \text{Eq.(23)}$$

In these lines, the pixels with the index 4*i* and 4*i*+2 are being printed. As the pixel response matrix (Eq.(20)) has on its first row a non-zero coefficient for the second neighbour, there will be a direct interaction for all the pixels being printed at sub line 0.

For sub line 1:

$$t_{4i+1}^{nib}=t_{4i+1}^{e}+\alpha_1 t_{4i}^{e}+\alpha_1 t_{4i+2}^{e}+\zeta_2 t_{4i-1}^{e}+\zeta_2 t_{4i+3}^{e}+t_1^{add}. \quad \text{Eq.(24)}$$

and $$t_{4i+3}^{nib}=t_{4i+3}^{e}+\alpha_1 t_{4i+2}^{e}+\alpha_1 t_{4i+4}^{e}+\zeta_2 t_{4i+1}^{e}+\zeta_2 t_{4i+5}^{e}+t_1^{add}. \quad \text{Eq.(25)}$$

In this case, some latent heat from sub line 0 coming from the 4*i*, 4*i*+2 and 4*i*+4 nibs is added, being a fraction $\alpha_1$ of $t_{4i}$, $t_{4i+2}$ and $t_{4i+4}$. Also, the $\zeta_2$ interaction is also here present for all the pixels being printed at this sub line.

We do have now the four equations describing the cross-talk between the several nibs. In the present case, the obtained nib temperatures $t_i^{nib}$ must be equal to a value $t_i^{wanted}$, as to have equal sized output pixels in all cases. The equations can be solved for the unknown excitation times $t_i^e$ that have to be used for the individual nibs. This gives the following set of equations:

$$\begin{bmatrix} 1 & 0 & \zeta_2 & 0 & 0 & 0 & 0 & \cdots \\ \alpha_1 & 1 & \alpha_1 & \zeta_2 & 0 & 0 & 0 & \cdots \\ \zeta_2 & 0 & 1 & 0 & \zeta_2 & 0 & 0 & \cdots \\ 0 & \zeta_2 & \alpha_1 & 1 & \alpha_1 & \zeta_2 & 0 & \cdots \\ 0 & 0 & \zeta_2 & 0 & 1 & 0 & \zeta_2 & \cdots \\ 0 & 0 & 0 & \zeta_2 & \alpha_1 & 1 & \alpha_1 & \cdots \\ 0 & 0 & 0 & 0 & \zeta_2 & 0 & 1 & \cdots \\ \vdots & \vdots & \vdots & \vdots & \vdots & \vdots & \vdots & \ddots \end{bmatrix} \begin{pmatrix} t_0^e \\ t_1^e \\ t_2^e \\ t_3^e \\ t_4^e \\ t_5^e \\ t_6^e \\ \vdots \end{pmatrix} = \begin{pmatrix} t_0^{wanted} \\ t_1^{wanted}-t_1^{add} \\ t_2^{wanted} \\ t_3^{wanted}-t_1^{add} \\ t_4^{wanted} \\ t_5^{wanted}-t_1^{add} \\ t_6^{wanted} \\ \vdots \end{pmatrix} \quad \text{Eq. (26)}$$

This system of equations can be solved using known mathematical techniques, e.g. like can be found in "LU Decomposition and Its Applications, §2.3 in Numerical Recipes in FORTRAN: The art of Scientific Computing, 2nd ed. Cambridge, England: Cambridge University Press, pp. 34–42, 1992".

Whenever variable image data is present, an iterative solution process is followed, this with the purpose of finding a best physical solution which can be applied during the printing process. In a first step, the vector $t_n^e$ is initialised according the image information:

$$\begin{pmatrix} t_0^e \\ t_1^e \\ t_2^e \\ t_3^e \\ t_4^e \\ t_5^e \\ t_6^e \\ \vdots \end{pmatrix} = \begin{pmatrix} t_{ref}\cdot p_0 \\ t_{ref}\cdot p_1 \\ t_{ref}\cdot p_2 \\ t_{ref}\cdot p_3 \\ t_{ref}\cdot p_4 \\ t_{ref}\cdot p_5 \\ t_{ref}\cdot p_6 \\ \vdots \end{pmatrix}, \quad \text{Eq. (27)}$$

with $p_0$, $p_1$, $p_2$, . . . containing the image information and being '1' when the pixel needs to be printed and '0' if the pixel is absent.

In a second step, a vector $t_n^{relax}$ is resolved using:

$$\begin{pmatrix} t_0^{relax} \\ t_1^{relax} \\ t_2^{relax} \\ t_3^{relax} \\ t_4^{relax} \\ t_5^{relax} \\ t_6^{relax} \\ \vdots \end{pmatrix} = \begin{bmatrix} 1 & 0 & \zeta_2 & 0 & 0 & 0 & 0 & \cdots \\ \alpha_1 & 1 & \alpha_1 & \zeta_2 & 0 & 0 & 0 & \cdots \\ \zeta_2 & 0 & 1 & 0 & \zeta_2 & 0 & 0 & \cdots \\ 0 & \zeta_2 & \alpha_1 & 1 & \alpha_1 & \zeta_2 & 0 & \cdots \\ 0 & 0 & \zeta_2 & 0 & 1 & 0 & \zeta_2 & \cdots \\ 0 & 0 & 0 & \zeta_2 & \alpha_1 & 1 & \alpha_1 & \cdots \\ 0 & 0 & 0 & 0 & \zeta_2 & 0 & 1 & \cdots \\ \vdots & \vdots & \vdots & \vdots & \vdots & \vdots & \vdots & \ddots \end{bmatrix} \begin{pmatrix} t_0^e \\ t_1^e \\ t_2^e \\ t_3^e \\ t_4^e \\ t_5^e \\ t_6^e \\ \vdots \end{pmatrix} + \begin{pmatrix} 0 \\ t_1^{add} \\ 0 \\ t_1^{add} \\ 0 \\ t_1^{add} \\ 0 \\ \vdots \end{pmatrix} \quad \text{Eq. (28)}$$

and gives the equivalent excitation time that would be present in the nib when the excitation vector $t_n^e$ has been used.

The values $t_n^{relax}$ are now modified in a third step with the image information:

$$\begin{pmatrix} t_0^{relax} \\ t_1^{relax} \\ t_2^{relax} \\ t_3^{relax} \\ t_4^{relax} \\ t_5^{relax} \\ t_6^{relax} \\ \vdots \end{pmatrix} = \begin{pmatrix} t_{ref} \cdot p_0 \\ t_{ref} \cdot p_1 \\ t_{ref} \cdot p_2 \\ t_{ref} \cdot p_3 \\ t_{ref} \cdot p_4 \\ t_{ref} \cdot p_5 \\ t_{ref} \cdot p_6 \\ \vdots \end{pmatrix} + \begin{pmatrix} t_0^{relax} \cdot (1 - p_0) \\ t_1^{relax} \cdot (1 - p_1) \\ t_2^{relax} \cdot (1 - p_2) \\ t_3^{relax} \cdot (1 - p_3) \\ t_4^{relax} \cdot (1 - p_4) \\ t_5^{relax} \cdot (1 - p_5) \\ t_6^{relax} \cdot (1 - p_6) \\ \vdots \end{pmatrix}. \quad \text{Eq. (29)}$$

These values give in fact the $t_n^{wanted}$ temperatures that we would like to have in the nibs.

A first iterative value is obtained in a fourth step for the actual excitation times $t_n^e$ by solving the following equation:

$$\begin{bmatrix} 1 & 0 & \zeta_2 & 0 & 0 & 0 & 0 & \cdots \\ \alpha_1 & 1 & \alpha_1 & \zeta_2 & 0 & 0 & 0 & \cdots \\ \zeta_2 & 0 & 1 & 0 & \zeta_2 & 0 & 0 & \cdots \\ 0 & \zeta_2 & \alpha_1 & 1 & \alpha_1 & \zeta_2 & 0 & \cdots \\ 0 & 0 & \zeta_2 & 0 & 1 & 0 & \zeta_2 & \cdots \\ 0 & 0 & 0 & \zeta_2 & \alpha_1 & 1 & \alpha_1 & \cdots \\ 0 & 0 & 0 & 0 & \zeta_2 & 0 & 1 & \cdots \\ \vdots & \vdots & \vdots & \vdots & \vdots & \vdots & \vdots & \ddots \end{bmatrix} \begin{pmatrix} t_0^e \\ t_1^e \\ t_2^e \\ t_3^e \\ t_4^e \\ t_5^e \\ t_6^e \\ \vdots \end{pmatrix} = \begin{pmatrix} t_0^{relax} \\ t_1^{relax} - t_1^{add} \\ t_2^{relax} \\ t_3^{relax} - t_1^{add} \\ t_4^{relax} \\ t_5^{relax} - t_1^{add} \\ t_6^{relax} \\ \vdots \end{pmatrix}. \quad \text{Eq. (30)}$$

Using the $t_n^e$ values found, a new iteration can be started by departing from the second step in Eq.(28). The process can be repeated until the iterated values of $t_n^e$ have converged to a value with desired accuracy. These excitation times can then be used for driving the power delivery to the heater elements.

For the experimental determination of the cross-talk coefficients $\zeta_2$ and $\alpha_1$, a print pattern can be used for isolating the effect of every coefficient. Using the de-convolution algorithm during the printing process itself, each coefficient can be tuned until all pixels are equal-sized or equal-dense for the given pattern. E.g. for the $\zeta_2$ coefficient, the following pattern can be used.

Pattern 3: (for $\zeta_2$)

$$\begin{bmatrix} 1_{4i} & 0 & 1_{4i+2} & 0 & 0 & 1_{4i+1} & 0 & 1_{4(i+1)+3} & 0 & 0 & 0 & 0 \\ 0 & 0 & 0 & 0 & 0 & 0 & 0 & 0 & 0 & 0 & 0 & 0 \\ 0 & 0 & 1_{4i+2} & 0 & 0 & 0 & 0 & 1_{4(i+1)+3} & 0 & 0 & 0 & 0 \\ 0 & 0 & 0 & 0 & 0 & 0 & 0 & 0 & 0 & 0 & 0 & 0 \end{bmatrix},$$

which shows two print lines, giving the interaction between the 4*i* and the 4*i*+2 pixel and also between the 4*i*+1 and the 4*i*+3 pixel. The coefficient $\zeta_2$ must be chosen in such a way that the 4*i*+2 pixel printed adjacent to the 4*i* pixel is equal sized or equal dense to the 4*i*+2 pixel printed isolated (first line in Pattern 3). In fact two different values can be found for $\zeta_2$ as there are in this case two different experiments possible (4*i*+2 influenced by 4*i* and 4*i*+1 influenced by 4*i*+3). When the cross-talk model would be correct, all the values of $\zeta_2$ found would be the same. When different values of $\zeta_2$ are found, an error probably is present in the cross-talk model (Eq.(21)), meaning that coefficients taken zero in the cross-talk matrix in fact are not zero. In that case, cross-talk coefficients must be added and the whole compensation algorithm has to be redone.

As another example, a pattern for tuning the $\alpha_1$ coefficient is given:

Pattern 4 (for $\alpha_1$):

$$\begin{bmatrix} 1_{4i} & 1_{4i+1} & 0 & 0 & 0 & 1_{4(i+1)+1} & 1_{4(i+1)+2} & 0 & 0 & 0 & 0 & 0 \\ 0 & 0 & 0 & 0 & 0 & 0 & 0 & 0 & 0 & 0 & 0 & 0 \\ 0 & 1_{4i+1} & 0 & 0 & 0 & 1_{4(i+1)+1} & 0 & 0 & 0 & 0 & 0 & 0 \\ 0 & 0 & 0 & 0 & 0 & 0 & 0 & 0 & 0 & 0 & 0 & 0 \end{bmatrix}.$$

Correct tuning of a1 should give for the 4*i*+1 pixel sizes that are not influenced by the presence of the 4*i* or 4*i*+2 pixel.

Referring to FIG. 5, there is shown a global principle schema of a thermal printing apparatus 10 that can be used in accordance with the present invention (known from e.g. EP 0 724 964, in the name of Agfa-Gevaert). This apparatus is capable of printing lines of pixels (or picture elements) on a thermographic recording material m, comprising thermal imaging elements or (shortly) imaging elements, often symbolised by the letters le. As an imaging element le is part of a thermographic recording material m, both are indicated in the present specification by a common reference number 5. The thermographic recording material m comprises on a support a thermosensitive layer, and generally is in the form of a sheet. The imaging element 5 is mounted on a rotatable platen or drum 6, driven by a drive mechanism (not shown) which continuously advances (see arrow Y representing a so-called slow-scan direction) the drum 6 and the imaging element 5 past a stationary thermal print head 20. This head 20 presses the imaging element 5 against the drum 6 and receives the output of the driver circuits (not shown in FIG. 1 for the sake of greater clarity). The thermal print head 20 normally includes a plurality of heater elements equal in number to the number of pixels in the image data present in a line memory. The image wise heating of the heater element is performed on a line by line basis (along a so-called fast-scan direction X which generally is perpendicular to the slow-scan direction Y), the "line" may be horizontal or vertical depending on the configuration of the printer, with the heater resistors geometrically juxtaposed each along another and with gradual construction of the output density. Each of these resistors is capable of being energised by heating pulses, the energy of which is controlled in accordance with the required density of the corresponding picture element. As the image input data have a higher value, the output energy increases and so the optical density of the hardcopy image 7 on the imaging element 5. On the contrary, lower density image data cause the heating energy to be decreased, giving a lighter picture 7.

Figure 6:
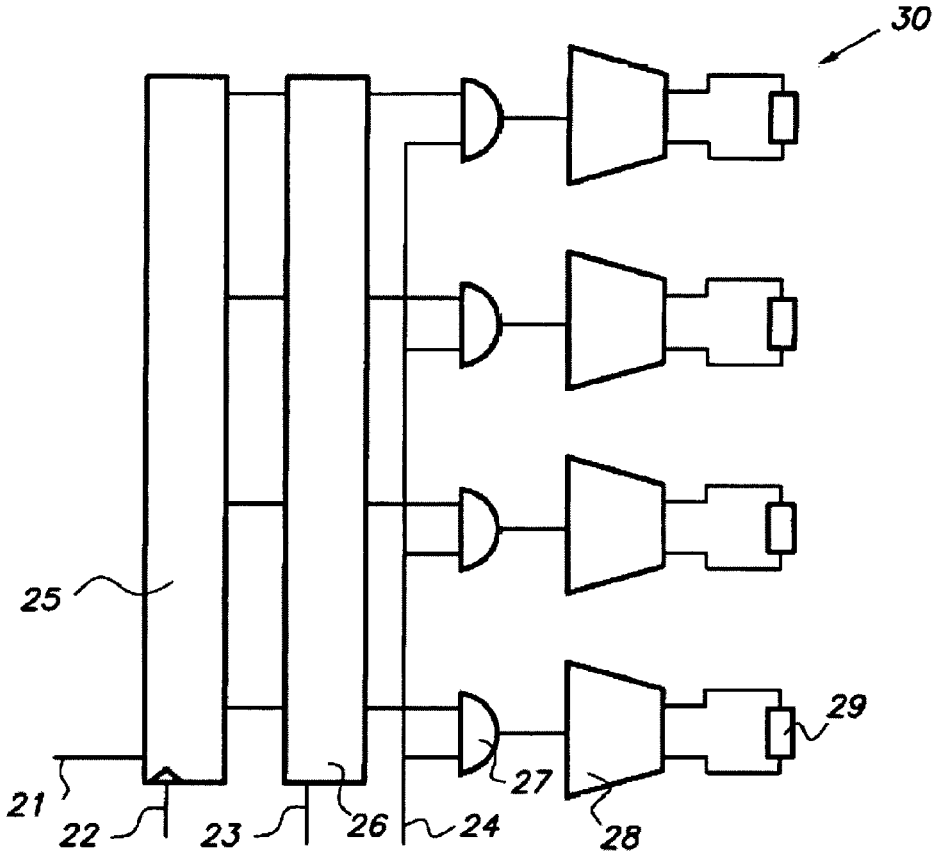
FIG. 6 shows a control circuitry in a thermal print head comprising resistive heater elements with which the present invention can be used.

The activation of the heater elements is preferably executed pulse wise and preferably by digital electronics. Some steps up to activation of said heater elements are illustrated in FIG. 5 and FIG. 6. First, input image data 16 are applied to a processing unit 18. After processing and parallel to serial conversion (not shown) of the digital image signals, a stream of serial data of bits is shifted (via serial input line 21) into a shift register 25, thus representing the next line of data that is to be printed. Thereafter, under control of a latch enabling line 23, these bits are supplied in parallel to the associated inputs of a latch register 26. Once the bits of data from the shift register 25 are stored in the latch register 26, another line of bits can be sequentially clocked (see ref. nr. 22) into said shift register 25. A strobe signal 24 controls AND-gates 27 and feeds the data from latching register 26 to drivers 28, which are connected to heater elements 29. These drivers 28 (e.g. transistors) are selectively turned on by a control signal in order to let a current flow through their associated heater elements 29.

The recording head 20 is controlled so as to produce in each pixel the density value corresponding with the processed digital image signal value. In this way a thermal hard-copy 7 of the electrical image data is recorded. By varying the heat applied by each heater element to the carrier, a variable density image pixel is formed. The thermal printing apparatus 10 is therefore provided with a control unit 30. The control unit 30 may include a computing device, e.g. microprocessor, for instance it may be a microcontroller. In particular, it may include a programmable printer controller, for instance a programmable digital logic element such as a Programmable Array Logic (PAL), a Programmable Logic Array, a Programmable Gate Array, especially a Field Programmable Gate Array (FPGA). The use of an FPGA allows subsequent programming of the printer device, e.g. by downloading the required settings of the FPGA. This control unit 30 is adapted to drive the heater elements in subsets to print pixel areas in each line so as to form sub lines. The control unit 30 is furthermore adapted for reducing the cross-talk between pixel areas printed by heater elements in the same or different subsets by calculating a value relating to heat supplied to a first heater element in accordance with a predetermined relationship relating the effect of heat from one heater element after activation thereof on the graphical output of neighbouring heater elements, and for driving the first heater element in accordance with the calculated value.

It is to be understood that although preferred embodiments have been discussed herein for devices according to the present invention, changes or modifications in form and detail may be made without departing from the scope and spirit of this invention. For example the heater elements may be electrically excited heater elements based on the Joule effect, directly (conductively) or indirectly (capacitively, inductively or RF) supplied from a voltage source. Alternatively, the heater elements may be based on a light or IR to heat conversion. In still another embodiment, the heater elements may be based on exothermal chemical, biological or pyrotechnic controllable reactions. Applications can be found in the field of half-tone printing, using equal sized and equal dense pixels or the continuous tone printing, having pixels with varying density. The present invention can be applied both in greyscale or binary printing and for printing colour images with photographic quality.

The invention claimed is:

1. A method for reducing cross-talk between pixel areas printed in a line on a thermographic material (m) by a thermal printing system comprising a thermal printer with a thermal head (TH) having a set of energisable heater elements (Hn), the energisable heater elements (Hn) being drivable with at least one activation pulse for supplying a controllable amount of heat to the heater elements to generate a graphical output level (Gn) of pixel areas on the thermographic material, wherein a plurality of subsets (Ns) of the heater elements are sequentially driving elements to print pixel areas in each line and wherein the crosstalk between pixel areas printed by heater elements in the same and/or different subsets is reduced by the steps of:

calculating a value relating to heat supplied to an $n^{th}$ heater element from any one other heater element after activation thereof, in accordance with a predetermined relationship relating the effect of heat from any said one other heater element after activation thereof on the graphical output of all heater elements in a same and/or a different subset and driving the $n^{th}$ heater element in accordance with the calculated value.

2. A method according to claim 1 wherein the predetermined relationship is a discrete set of coefficients relating the effects of heat from one heater element after activation thereof on the graphical output of said heater elements in the same and/or a different subset in space and time.

3. A method according to claim 2, wherein the predetermined relationship is in the form of a matrix.

4. A method according to claim 3, the matrix having coefficients ($h_{r,n}$), where the coefficients ($h_{r,n}$) of the matrix are found on an experimental a posteriori base by using a special graphical printout of pixels chosen in such a way that a graphical output level (Gn) is influenced by a single pixel (p) with a corresponding heat transfer coefficient ($h_{r,n}$), allowing to adjust this coefficient until the graphical output level is identical to the same graphical output level when being printed when p is not excited.

5. A method according to claim 1 furthermore comprising line to line latent heat compensation.

6. A method according to claim 1 further comprising the steps of:

building system equations that relate the excitation an actual heater element will get as a result of the contributions of the heater elements in the same and/or different subset being driven, based upon the predetermined relationship, the actual heater element excitation and the non-image related sub line heat production vector, for every line to be printed, putting the total excitation value ($t_n^{total}$) equal to a first reference value (tref) for every pixel that will be printed and equal to a second value ($t_n^{relax}$) for every pixel not being printed, solving the system of equations for the unknown values ($t_n^{e}$) of excitations to be applied to the heater elements, and repeating the above sequence by recalculating the second values ($t_n^{relax}$) and resolving the system of equations until the vector of excitation values ($t_n^{e}$) converges with an acceptable error.

7. A method according to claim 6, wherein the second value is calculated from the system equations using for the first time the first reference value ($t^{ref}$) for the excited heater elements and in subsequent iterations, the excitation values found ($t_n^e$) at the heater elements being excited and a zero-value at the non-excited heater elements.

8. A method according to claim 6 wherein the step of building the system equations further comprises:

defining the printing sequence by selecting for every heater element in what sub line the heater element will be excited: $t_{r,n}^e$, r the sub line number, n the heater element number, for every excited heater element, using a convolution principle and the predetermined relationship, the resulting total equivalent pixel excitation $t_{r,n}^{total}$ being calculated using:

$$t_{r,n}^{total} = \sum_{j=0}^{r} \left[ \sum_{i=0}^{n} t_{r-j,n-i}^{e} H_{j,i} + \sum_{i=1}^{N_{nibs}-1-n} t_{r-j,n+i}^{e} H_{j,i} \right] + t_r^{add},$$

$$r = 0, \ldots, N_s - 1 \quad n = 0, \ldots, N_{nibs} - 1.$$

based on the selected excitation scheme, for heater element n, focus only on the equivalent steering time $t_{rn}^{total}$ in the sub line r, the actual sub line wherein the heater element is actively excited, giving in total $N_{nibs}$ equations for $N_{nibs}$ unknown excitation values.

9. A method according to claim 8, where the basic convolutional expression is replaced by an expression giving an isolated boundary condition in the thermal head:

$$t_{r,n}^{total} = \sum_{j=0}^{r} \left[ \sum_{i=0}^{N_{nibs}-1} t_{r-j,\zeta}^{e} H_{j,i} + \sum_{i=1}^{N_{nibs}-1-n} t_{r-j,\eta}^{e} H_{j,i} \right] + t_r^{add}$$

-continued with $\zeta = |n - i|$ and if $(n+i)>(N_{nibs}-1)$ then $\eta=2(N_{nibs}-1)-n-i$, else $\eta=n+i$.

10. A control unit for use with a thermal printer for printing an image onto a thermographic material, the thermal printer having a thermal head having a set of energisable heater elements, the control unit being adapted to control the driving of the heater elements with at least one activation pulse for supplying a controllable amount of heat to the heater elements to generate a graphical output level of pixel areas on the thermographic material, the control unit furthermore being adapted for controlling the driving of a plurality of subsets of the heater elements to print pixel areas in each line, and for reducing the cross-talk between pixel areas printed by heater elements in a same or different subsets by calculating a value relating to heat supplied to a first heater element from any one other heater element in accordance with a predetermined relationship relating the effect of heat from said one other heater element after activaiton thereof on the graphical output level of all heater elements in the same and/or different subsets, and driving the first heater element in accordance with the calculated value.

11. A thermal print head provided with a control unit according to claim 10.

12. A computer program product for executing the method as claimed in claim 1 when executed on a computing device associated with a thermal print head.

13. A machine readable data storage device storing the computer program product of claim 12.

* * * * *